US007953359B2

(12) United States Patent
Kobayashi et al.

(10) Patent No.: US 7,953,359 B2
(45) Date of Patent: May 31, 2011

(54) APPARATUS FOR HEATING AN IMAGE FORMED ON A RECORDING MATERIAL

(75) Inventors: Shinsuke Kobayashi, Susono (JP); Akira Kato, Mishima (JP); Akira Hayakawa, Mishima (JP); Kenichi Ogawa, Numazu (JP); Hisashi Nakahara, Numazu (JP); Tatsuo Nishiyama, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 11/302,328

(22) Filed: Dec. 14, 2005

(65) Prior Publication Data

US 2006/0133868 A1 Jun. 22, 2006

(30) Foreign Application Priority Data

Dec. 20, 2004 (JP) ..... 2004-367624

(51) Int. Cl.
*G03G 15/20* (2006.01)

(52) U.S. Cl. ..... 399/328; 399/329

(58) Field of Classification Search ..... 399/328, 399/329

See application file for complete search history.

(56) References Cited

U.S. PATENT DOCUMENTS 5,708,926 A * 1/1998 Sagara et al. ..... 399/328
5,860,052 A 1/1999 Ohtsuka et al. ..... 399/329
6,944,420 B2 9/2005 Kanamori et al.
2003/0206756 A1 11/2003 Kanamori et al.
2005/0036809 A1* 2/2005 Fukita et al. ..... 399/328
2006/0067751 A1* 3/2006 Gilmore ..... 399/329

FOREIGN PATENT DOCUMENTS

CN 1453666 A 11/2003
JP 2001-27858 1/2001

OTHER PUBLICATIONS

Notification of First Office Action issued on Jan. 4, 2008, in Chinese Patent Application No. 2005101318563, including an English-language translation.

* cited by examiner

*Primary Examiner* — David M Gray
*Assistant Examiner* — Billy J Lactaoen
(74) *Attorney, Agent, or Firm* — Fitzpatrick, Cella, Harper & Scinto

(57) ABSTRACT

An image heating apparatus for heating an image formed on a recording material, including a heating unit having a heater and a flexible sleeve to be rotated in contact with the heater; an elastic roller for constituting a nip portion, in cooperation with the heater and through the flexible sleeve, for heating the recording material under pinching and conveying; and a frame having a roller supporting portion for supporting the heating unit and the elastic roller; wherein the frame has a guide portion for mounting the heating unit on the frame; and the roller supporting portion of the frame is positioned, in a conveying direction of the recording material, in a downstream position of an imaginary line passing through a center of the guide portion.

4 Claims, 15 Drawing Sheets

APPARATUS FOR HEATING AN IMAGE FORMED ON A RECORDING MATERIAL

BACKGROUND OF THE INVENTION

1. Field of the Invention

The present invention relates to an image heating apparatus for using as an image heat fixing apparatus in an image forming apparatus such as a copying apparatus, a laser beam printer, a facsimile apparatus and the like.

2. Related Background Art

As a fixing apparatus to be incorporated in an image forming apparatus, already commercialized is an apparatus including a ceramic heater, a heat resistant sleeve rotating in contact with the ceramic heater, and a pressure roller constituting a fixing nip portion with the ceramic heater through the heat resistant sleeve. A recording sheet bearing an unfixed toner image is pinched between and conveyed by the heat resistant sleeve and the pressure roller, whereby the unfixed toner image is heat fixed to the recording sheet. Such fixing apparatus, having a low heat capacity, provides advantages of requiring a short time to reaching a fixable temperature and a low electric power consumption during a stand-by state awaiting an instruction for printing.

For improving the fixing property in an image heating apparatus of the above-described film heating type, as disclosed in FIG. 11 of Japanese Patent Application Laid-open No. 2001-27858, a configuration of forming a pressure distribution in the fixing nip portion so as to be larger in a downstream side than in an upstream side in the sheet conveying direction.

It is however found that, even when the pressure at the downstream side is made larger in the pressure distribution of the nip portion, an unnecessarily high pressure is applied while the toner is insufficiently fused in case heat transmission is not well balanced. Stated differently, it is found necessary, in order to secure satisfactory fixing property, to optimize the pressure distribution and the temperature distribution within the fixing nip portion, in the sheet conveying direction.

Also in order to reduce the cost of the apparatus, it is desirable to achieve the optimization of the pressure distribution and the temperature distribution within the fixing nip portion, in the sheet conveying direction, by a simple structure.

It is also desirable to realize an image heating apparatus capable of suppressing the electric power consumption while securing the fixing property, by a simple structure.

SUMMARY OF THE INVENTION

The present invention has been made in consideration of the foregoing, and an object thereof is to provide an image heating apparatus capable of securing a satisfactory fixing property with a simple structure.

Another object of the present invention is to provide an image heating apparatus capable of achieving a lower electric power consumption than in the prior technology, by a simple structure.

Still another object of the present invention is to provide an image heating apparatus including a heating unit having a heater, and a flexible sleeve rotating in contact with the heater; an elastic roller forming a nip portion with the heater through the flexible sleeve; wherein a recording material is heated while it is pinched (nipped) and conveyed by the nip portion; a frame for supporting the heating unit and the elastic roller, the frame including a roller supporting portion for supporting the elastic roller; wherein the frame has a guide portion for mounting the heating unit on the frame, and, in a conveying direction of the recording material, the roller supporting portion of the frame is positioned at a downstream side of an imaginary line passing a center of the guide portion.

Still other objects of the present invention will become fully apparent from the following detailed description which is to be taken in conjunction with the accompanying drawings.

DETAILED DESCRIPTION OF THE PREFERRED EMBODIMENTS

Embodiment 1

(1) Example of Image Forming Apparatus

Figure 16:
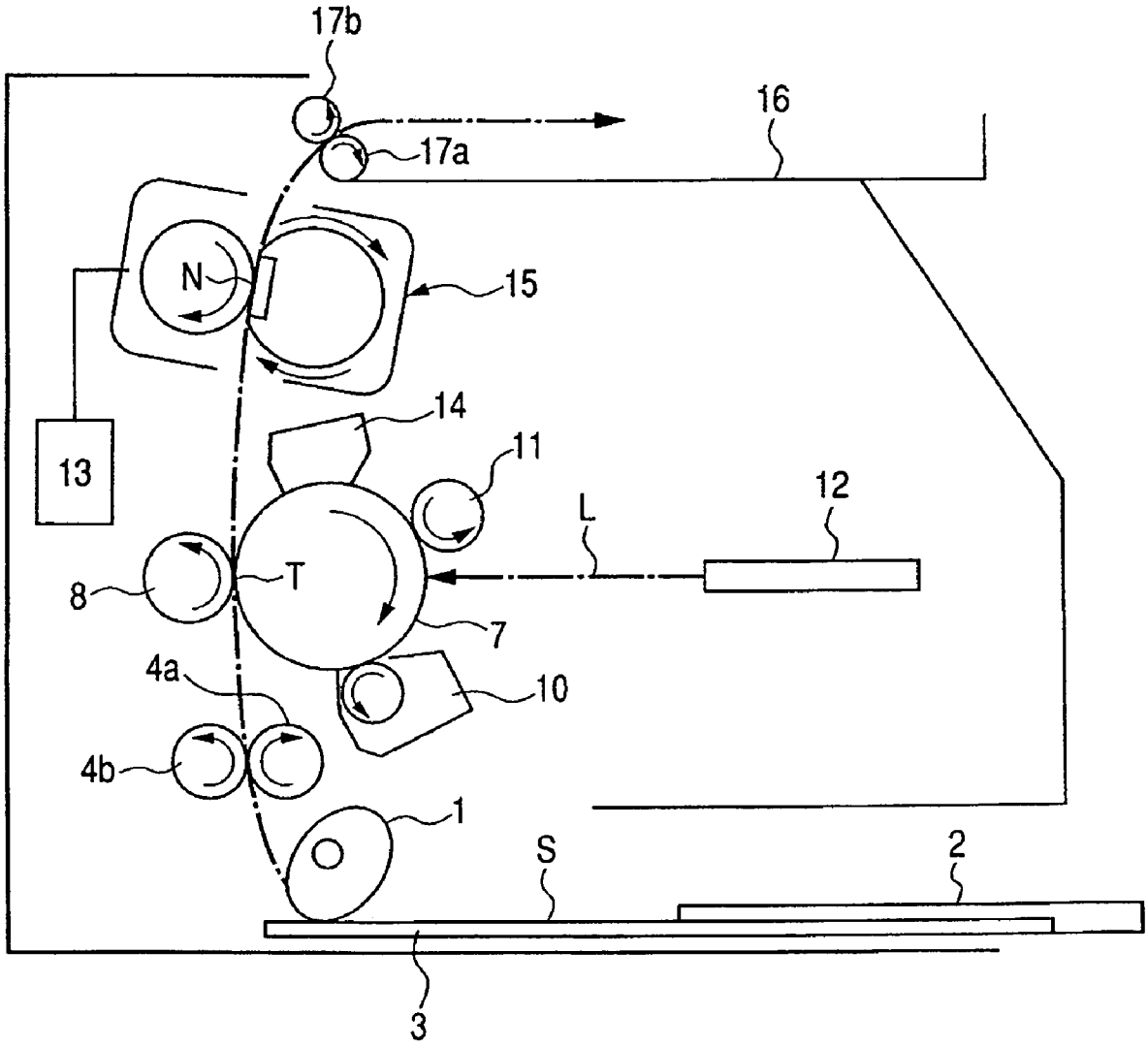
FIG. 16 is a schematic view showing a configuration of an image forming apparatus.

FIG. 16 is a schematic view showing a configuration of an image forming apparatus equipped with an image heating apparatus of the present invention as an image heat fixing apparatus. The image forming apparatus of the present embodiment is a laser beam printer utilizing an electrophotographic process of transfer type.

If a lower part of the image forming apparatus, a sheet feeding table 3 is provided. On the sheet feeding table, a transfer sheet (hereinafter simply represented as sheet) S as a recording material is inserted and set thereon. The sheet feeding table 3 is equipped with a movable member 2 for aligning a lateral side of the sheet. The sheet S inserted from the sheet feeding table 3 into the image forming apparatus (hereinafter simply represented as apparatus) is, after a front end detection by unillustrated detection means, fetched into the apparatus by a rotation of a sheet feed roller 1 at a predetermined control timing. The sheets fetched into the apparatus is supported between paired conveying rollers 4*a*, 4*b* and is introduced at a predetermined timing into a transfer portion T formed by a nip portion of a rotary photosensitive drum 7 and a transfer roller 8. The sheet S receives, at the transfer portion T, a transfer of a toner image which is formed corresponding to image information and borne on the external periphery of the rotary photosensitive drum 7.

The sheet S, having received the toner image in the transfer portion T, is separated from the surface of the rotary photosensitive drum 7, and is introduced into a fixing nip portion of an image heating apparatus (hereinafter represented as fixing apparatus) 15 to be explained later. The sheet S is subjected to a heat fixing process of the unfixed toner image in the course of being pinched in and conveyed through a fixing nip portion N. Then, after exiting from the fixing apparatus 15, the sheet is discharged through paired discharge rollers 17*a*, 17*b* onto a sheet discharge tray 16, in a face-down mode with the image bearing face downwards in case of the present embodiment.

The image forming apparatus is equipped with a laser scanner 12, which emits a laser beam L corresponding to image information entered from a host apparatus such as an unillustrated computer or an image reading apparatus, thereby irradiating the surface of the rotary photosensitive drum 7. Thus the surface of the rotary photosensitive drum 7 is scan exposed by such laser beam through an unillustrated mirrors.

A charging roller 11 for uniformly charging the surface of the rotary photosensitive drum 7 at predetermined polarity and potential is provided at an upstream position, in the rotating direction of the photosensitive drum 7, where it is irradiated by the laser beam L from the laser scanner 12. The surface, uniformly charged by the charging roller 11, of the rotary photosensitive drum 7 is scanned by the laser scanner to form an electrostatic latent image corresponding to the image information.

Such electrostatic latent image is rendered visible by a developing device 10 as a toner image which is transferred in the aforementioned transfer portion T onto the sheet S.

The surface of the rotary photosensitive member 7, after the toner image transfer onto the sheet S, is subjected to elimination of residual contaminants such as a transfer residual toner by a cleaning device 14, and is used again for image formation.

The image forming apparatus is provided with a central processing unit (CPU) 13 for controlling the entire image forming apparatus, and connected electrically to the fixing apparatus 15. The CPU 13 also controls a controlled temperature of the fixing apparatus 15 and a process speed of the main body of the image forming apparatus. In the present embodiment, the image forming apparatus has a default fixing temperature of 180° C. Also for an A4-sized plain paper, the CPU 13 conveys the sheet at a speed of 115 mm/sec and regulates a sheet interval so as to obtain a process speed of 18 ppm.

(2) Fixing Apparatus 15

In the following, the fixing apparatus 15, as the image heating apparatus in the present embodiment, will be explained in detail. The fixing apparatus 15 in the present embodiment is an apparatus of film heating type driven by a pressurizing rotary member, namely so-called tensionless type.

In the following description, a longitudinal direction in the fixing apparatus or in a constituent member thereof means, within a plane of sheet conveying path, a direction perpendicular to the sheet conveying direction. Also a shorter direction of the fixing apparatus or of a constituent member thereof means the sheet conveying direction. Also with respect to the fixing apparatus, a rear side means, when the fixing apparatus is seen from front (from sheet entrance side), a rear side (sheet exit side), and left or right means a left side or a right side when the fixing apparatus is seen from front. Also an upstream side and a downstream side means upstream or downstream in the sheet conveying direction.

Figure 1:
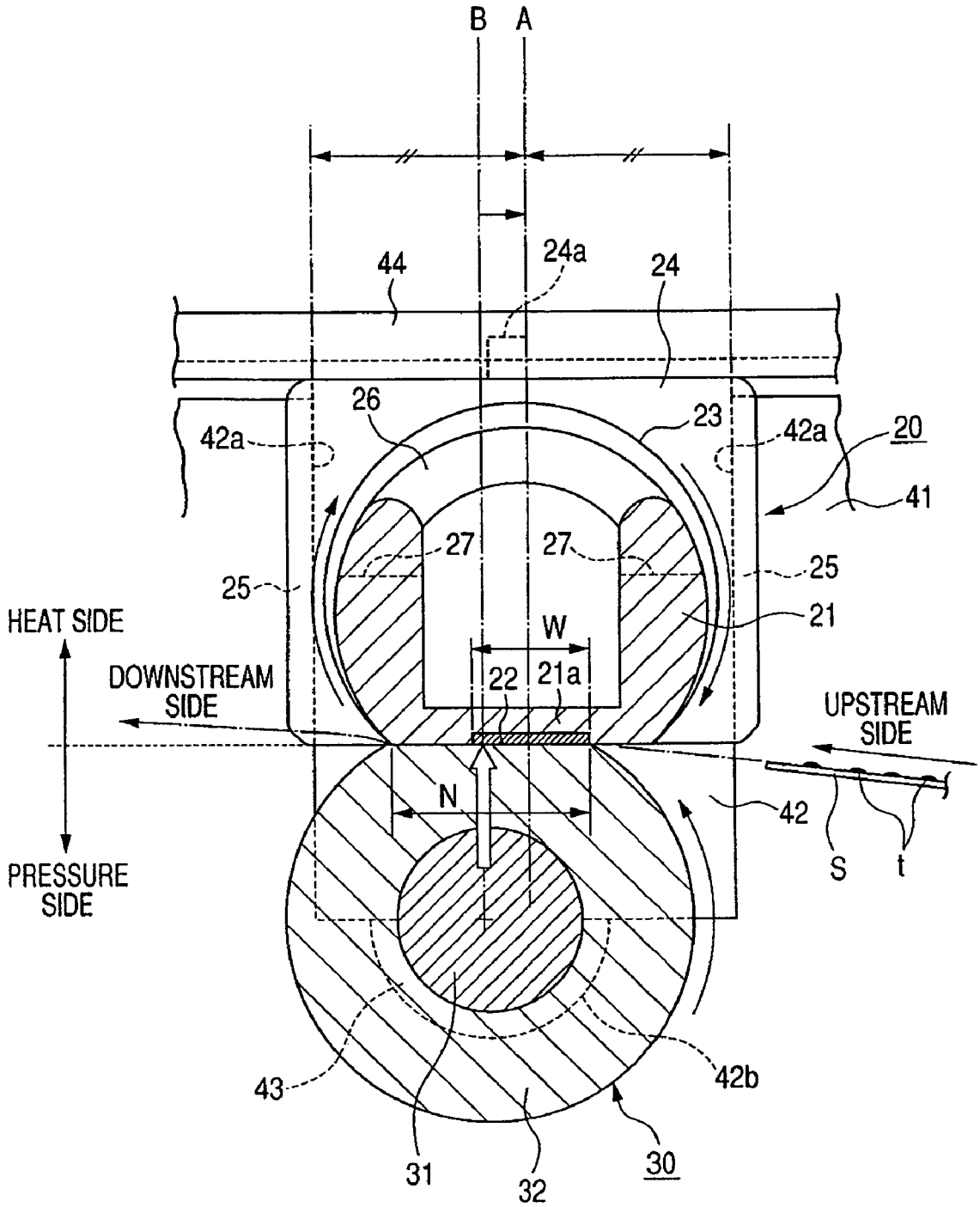
FIG. 1 is a magnified schematic lateral cross-sectional view of a principal portion of a fixing apparatus, constituting an image heating apparatus in an embodiment 1.
Figure 2A:
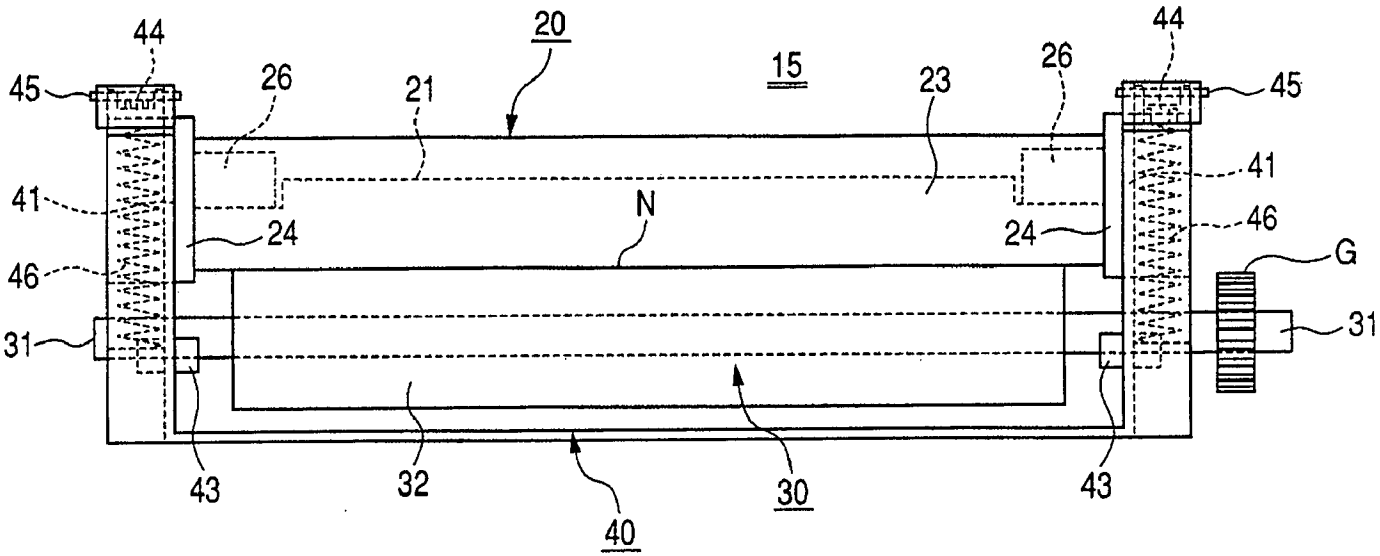
FIG. 2A is a frontal view of the fixing apparatus at a sheet entrance side.
Figure 2B:
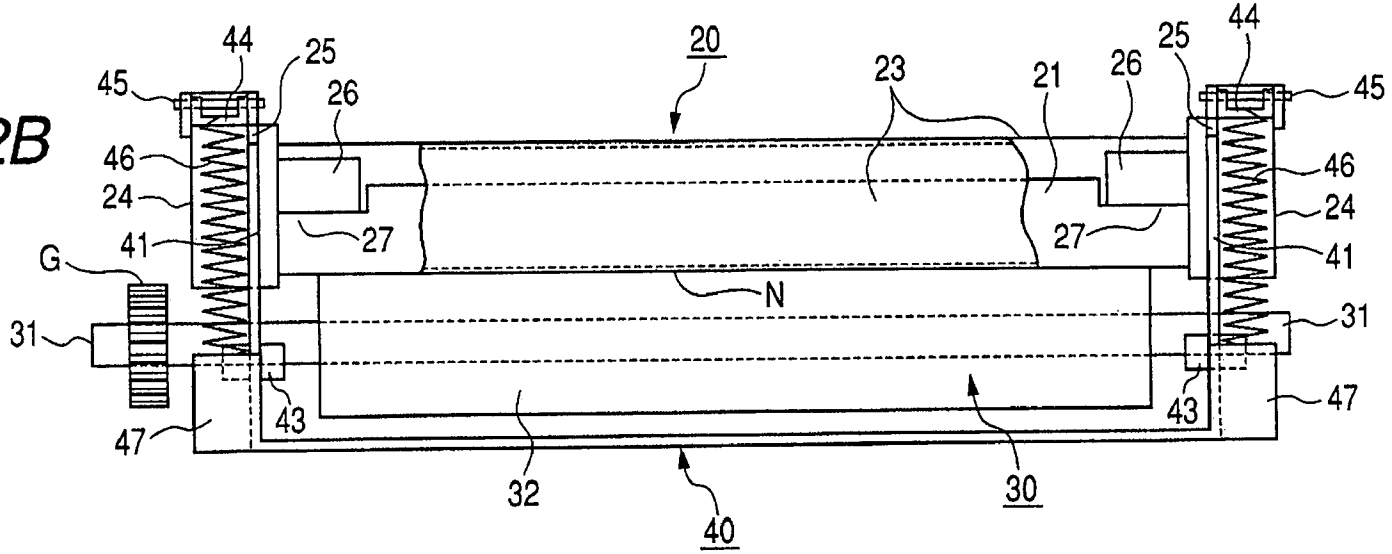
FIG. 2B is a partially cut-off rear view of the fixing apparatus at a sheet exit side.
Figure 3:
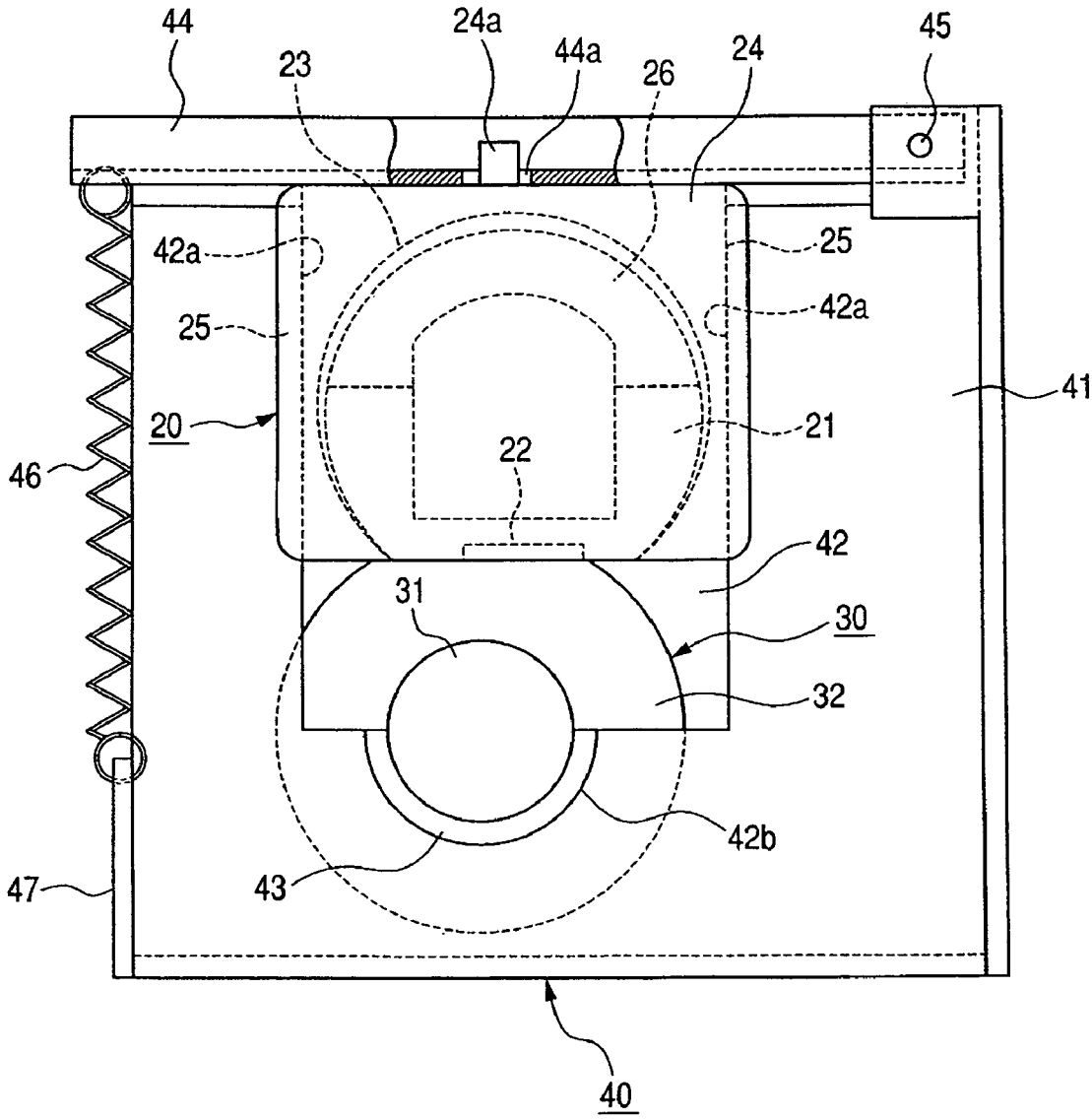
FIG. 3 is a partially cut-off magnified left-side lateral view of the fixing apparatus.
Figure 4:
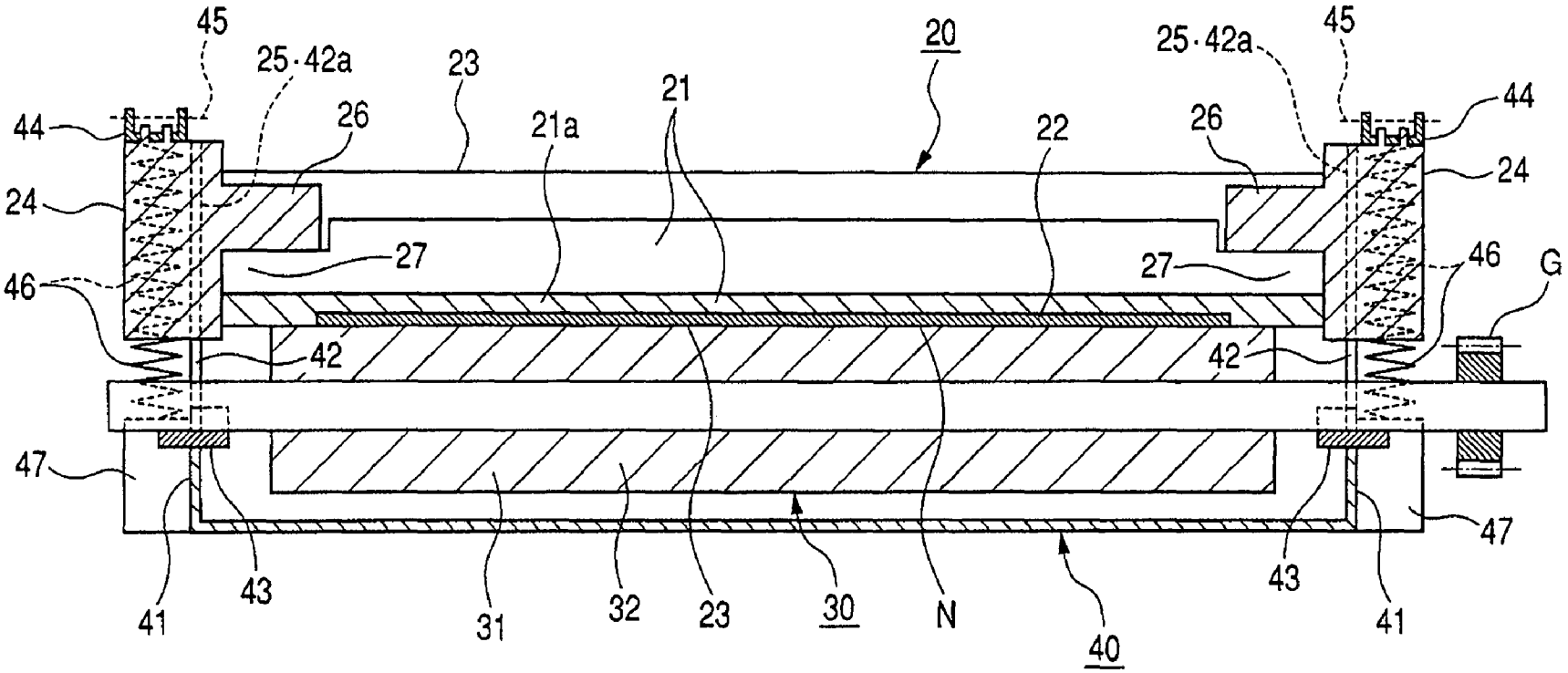
FIG. 4 is a frontal vertical cross-sectional view of the fixing apparatus.
Figure 5:
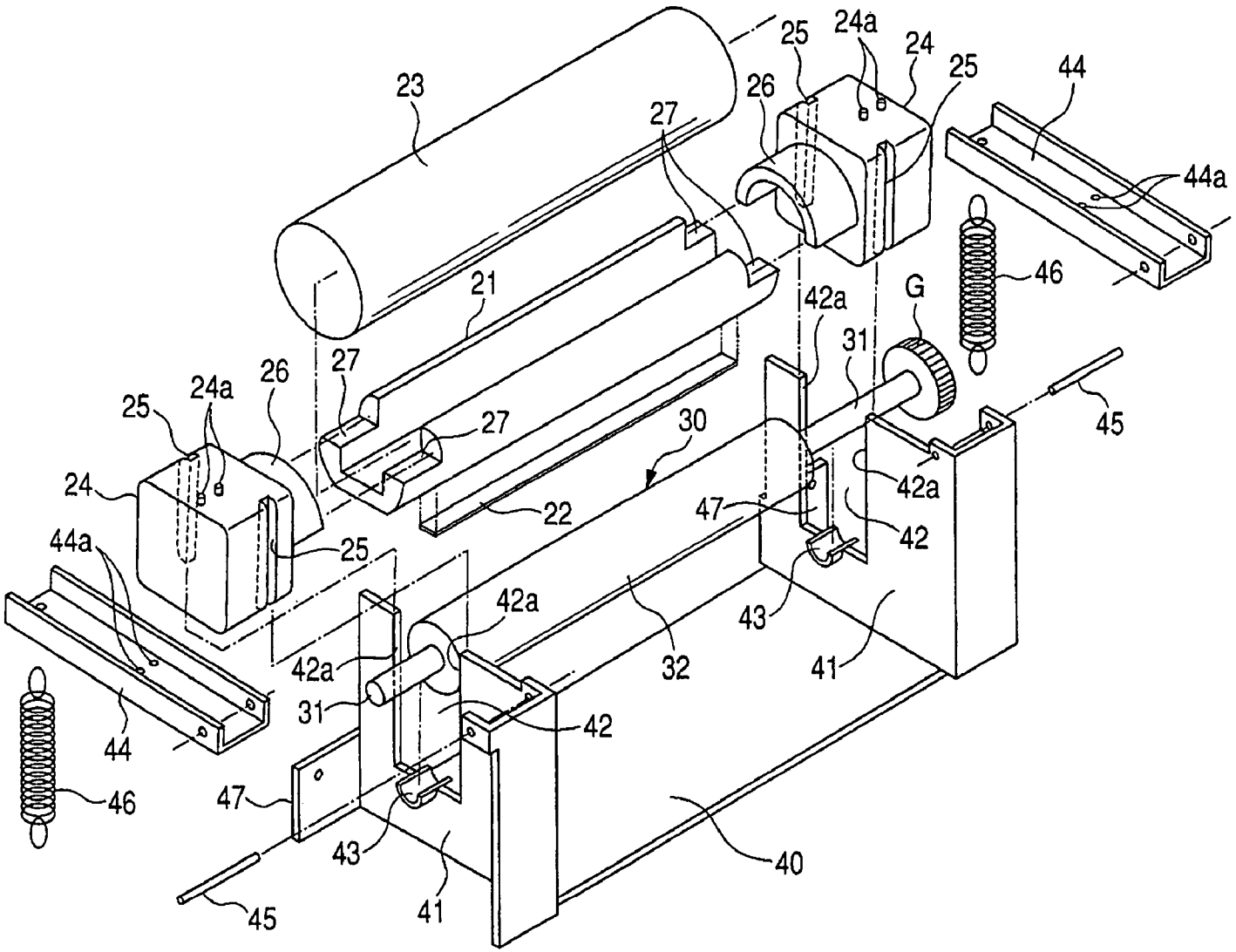
FIG. 5 is a schematic exploded perspective view of the fixing apparatus.

FIG. 1 is a magnified schematic cross-sectional view of a principal portion of a fixing apparatus serving as an image heating apparatus in the present embodiment; FIG. 2A is a frontal view of the fixing apparatus at a sheet entrance side; FIG. 2B is a partially cut-off rear view of the fixing apparatus at a sheet exit side; FIG. 3 is a partially cut-off magnified left-side lateral view of the fixing apparatus; FIG. 4 is a frontal vertical cross-sectional view of the fixing apparatus; and FIG. 5 is a schematic exploded perspective view of the fixing apparatus.

A heat unit (upper unit) 20 and a pressure roller (elastic roller) 30 are mutually positioned along an axial direction thereof, and positioned at opposite sides with respect to a conveying path for a sheet S. The heating unit 20 and the elastic roller 30 are supported in substantially parallel manner, between left and right lateral plates 41 of a metal plate frame (frame) 40 serving as a casing of the apparatus. The heating unit 20 and the elastic roller 30 are contacted under pressure to constitute a fixing nip portion N, serving as a heating nip.

The heating unit 20 is provided with a heat-resistant, rigid and laterally oblong guide member 21 for an internal surface of a film, a heater 22 fixed by being embedded in a recessed groove 21*a*, provided along the longitudinal direction of a lower face of the internal film surface guide member 21, a cylindrical fixing film 23 a heat-resistant resin constituting a flexible sleeve and loosely fitted around the internal film surface guide member 21 which supports the heater 22, and left and right flange members 24 mounted as film supporting members on both longitudinal ends of the internal film surface guide member 21.

In the aforementioned configuration, the heater 22 is for example so-called ceramic heater. The heater 22 in the present embodiment has a width W (FIG. 1) of 5.83 mm and has a plate shape elongated in a direction perpendicular to the sheet conveying direction.

The fixing film 23 is constituted for example of a heat-resistant resin such as polyimide. The fixing film 23 has an external peripheral length of about 57 mm, and an internal peripheral length larger by about 3 mm than the external peripheral length of the internal film surface guide member 21 including the heater 22. Therefore, the fixing film 23 has a margin in the peripheral length, with respect to the internal film surface guide member 21 including the heater 22. The left and right flange members 24 serve to restrict both end portions of the fixing film 23, thereby preventing a displacement thereof in the longitudinal direction.

The pressure roller 30 is a rotary member constituted of a metal core 31, and an elastic layer 32 prepared by foaming a heat-resistant rubber such as silicone rubber or fluorinated rubber, integrally formed on the metal core.

In the left and right lateral plates 41 of the metal plate frame 40, vertically oblong fitting grooves 42, open at the upper end, are formed in a same shape. In a roller supporting portion 42*b* provided at a lower end of each fitting groove 42, there is mounted a bearing member 43 of a heat resistant resin such as PEEK, PPS, or liquid crystal polymer. The left and right bearing members 43 support left and right ends of the metal core 31 of the pressure roller whereby the pressure roller 30 is rotatably supported between the left and right lateral plates 41. Thus, the pressure roller 30 is rotatably supported, through the bearing members 43, on the roller supporting portions 42*b* of the frame 40.

Also the left and right flange members 24 of the heating unit 20 are provided, as shown in FIG. 5, with vertical grooves 25 for fitting on the frame. Also vertical rims 42*a* of the fitting grooves 42 of the frame 40 constitute guides for mounting the heating unit 20 onto the frame 40. In mounting the heating unit 20 on the frame 40 of the flange member 24 is inserted into the fitting groove 42 of the frame 40 from an open end thereof, in such a manner that the vertical grooves 25 of the flange member 24 engage with the guide portions 42*a* of the frame 40. It is then made to slides toward the pressure roller 30, whereby the fixing film 23 comes into contact with the pressure roller 30 between the left and right lateral plates 41 of the frame 40. Therefore, the frame fitting vertical grooves 25 of the flange members 24 and the guide portions 42*a* of the frame 40 serve as guide members for guiding the heating unit 20, including the flange members 24, toward the pressure roller 30 between the left and right lateral plates 41 of the metal plate frames 40.

On the left and right flanges 24, mounted on the lateral plates 41 of the metal plate frame 40 as explained above, pressing metal plates 44 are respectively provided, as members for pressurizing upper surfaces of the flange members 24. The pressing metal plate 44 is rotatably articulated, at an end thereof, by a hinge shaft 45 on the upper surface of the left or right lateral plate 41 of the metal plate frame 40. The pressing metal plate 44 is so positioned as to be in contact with the upper surface of the corresponding left or right flange member 24. The other end of the pressing metal plate 44 is biased, by a pressurizing spring (tension spring) 46 supported by a fixed spring support member 47, in such a direction as to press the flange member 24 toward the pressure roller 30 about the hinge shaft 45 under the tensile force of the pressurizing spring 46. Left and right flange members 24 are integrally provided, on internal surfaces thereof, with pushing portions 26, which engage with pressure receiving portions 27 provided on both end portions of the internal film surface guide member 21. The pressures applied on the left and right flange members 24 form the pressing metal plates 44 is transmitted, through the pushing portions 26 and the pressure receiving portions 27, to the internal film surface guide member 21. Therefore, the lower surface of the internal film surface guide member 21, having the heater 22, is pressed, through the fixing film 23, to the pressure roller 30 against the elastic force of the elastic layer 32. In this manner the heating unit 20 and the pressure roller 30 are pressed under a predetermined pressure to form therebetween a fixing nip portion N of a predetermined width W as a heating nip portion. In the present embodiment, the pressurizing spring 46 has a total pressure of about 132.3N (13.5 kgf), and the fixing nip portion N has a width W of about 7.7 mm.

The pressing metal plate 44 is provided with holes 44*a*, while the flange member 24 is provided with protrusions 24*a* on the upper surface thereof. When the pressing metal plate 44 is rotated about the shaft 45 and comes into contact with the upper surface of the flange member 24, the protrusions 24*a* provided on the upper surface of the flange member 24 fit into the holes 44*a* provided in the pressing metal plate 44, thereby defining the position thereof.

The pressure roller 30 is rotated counterclockwise as indicated by an arrow in FIG. 1, at a predetermined speed, by a driving power transmitted from unillustrated rotation control means to a drive gear G, fixed at an end of the metal core The rotation of the pressure roller 30 applies a rotating power to the cylindrical fixing film 23, by the frictional contact force in the fixing nip portion N between the external surface of the pressure roller 30 and the fixing film 23. Under such frictional force, the fixing film 23 is rotated, with a sliding contact of the internal surface thereof with the lower surface of the heater 22 in the fixing nip portion N, around the external periphery of the internal film surface guide member 21. The heater 22 functions as a sliding member for the internal surface of the fixing film at the fixing nip portion N. A sheet S bearing an unfixed toner image t is introduced between the fixing film 23 and the pressure roller 30 in the fixing nip portion N, in a state where the pressure roller 30 is driven in rotation to rotate the cylindrical fixing film 23, and the heater 22 is given a current supply and is heat controlled at a predetermined temperature. Thus, the sheet S is contacted, in the fixing nip portion N, at the toner image bearing surface thereof with the external surface of the fixing film 23, and is pinched and conveyed in the fixing nip portion N.

During such pinched conveying process, the heat from the heater 22 is transmitted through the fixing film 23 to the sheet S whereby the unfixed toner image t on the sheet S is heated and pressed, thus being fused and fixed to the sheet S. The sheet S after passing the fixing nip portion N is separated from the fixing film 23 by a curvature thereof.

Figures 6A, 6B, 6C:
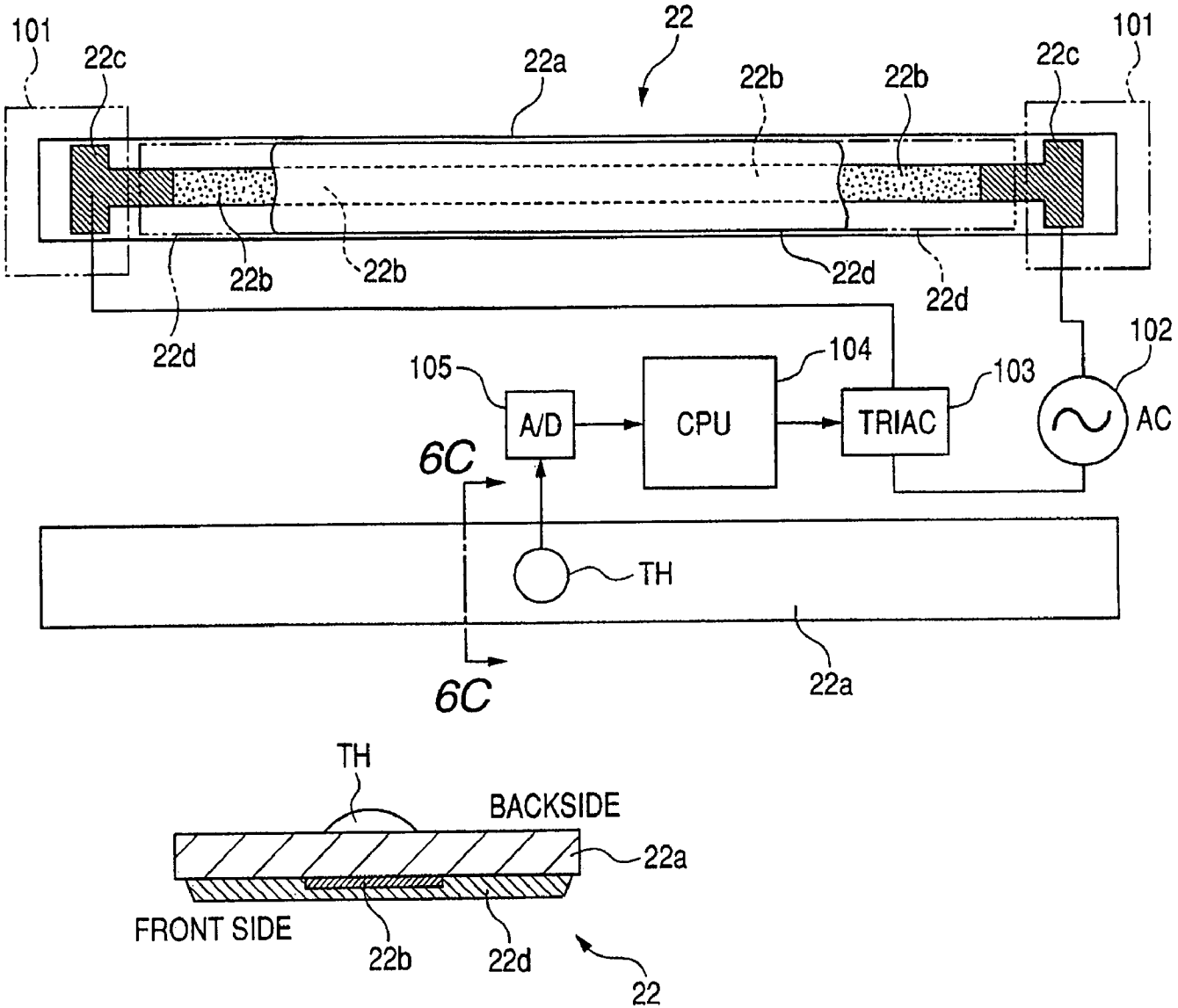
FIG. 6A is a schematic view showing a configuration of a theater surface side, in an embodiment of a ceramic heater as a heating member.
FIG. 6B is a schematic view showing a configuration of a heater rear side, in an embodiment of a ceramic heater as a heating member.
FIG. 6C is a magnified cross-sectional view along a 6C-6C line in FIG. 6B.

FIGS. 6A to 6C schematically illustrate an example of the ceramic heater 22 as the heating member. FIG. 6A is a schematic view showing a configuration of a heater surface side, in an embodiment of a ceramic heater as a heating member;

FIG. 6B is a schematic view showing a configuration of a heater rear side; and FIG. 6C is a magnified cross-sectional view along a 6C-6C line in FIG. 6B. The ceramic heater 22 is provided with is a ceramic substrate (insulating substrate) 22*a* of a high insulating ceramic material such as alumina, aluminum nitride or silicon carbide of a laterally elongated shape in a direction perpendicular to the sheet conveying direction, ii) a heat generating resistance member 22*b*, provided along the longitudinal direction on the surface side of the ceramic substrate 22*a* by coating and sintering for example Ag/Pd (silver/palladium), $RuO_2$, or $Ta_2N$, in a fine or stripe-shape of a thickness of about 10 μm and a width of 1-5 mm, iii) electrode portions 22*c* of Ag/Pt (silver/platinum) provided at and in electrical contact with both ends of the heat-generating resistance member 22*b*, iv) an insulating protective layer 22*d* such as of a glass coating or a fluorinated resin coating capable of withstanding the friction with the fixing film, and v) a thermistor TH provided on the rear side of the ceramic substrate 22*a* as a temperature detector.

The ceramic heater 22 mentioned above has a front surface at the side of the insulating protective layer 22*d*, on which the fixing film 23 slides. Such ceramic heater 22 is fitted and supported by a heat-resistant adhesive in a recessed groove 21*a* provided along the longitudinal direction of the lower surface of the internal film surface guide member 21.

Electric power supplying connectors 101 are respectively fitted on the electrodes 22*c* at the ends of the ceramic heater 22, fixed on and supported by the internal film surface guide member 21, and the electrodes 22*c* are respectively in contact with electrical contacts of the power supplying connectors.

The electrode 22*c* at an end is connected through the power supplying connector 101 to a commercial power source (AC) 102, and a triac 103 connected thereto is connected to the electrode 22*c* at the other end through the power supplying connector 101.

The triac 103 is connected to power (energizing) control means (CPU) 104. Under an electric power supply between the electrodes 22*c* from the commercial power source 102 through the triac 103, the heat-generating resistance member 22*b* generates heat whereby the ceramic heater 22 shows a rapid and steep temperature increase. The temperature increase in the ceramic heater 22 is detected by the thermistor TH serving as a temperature detector. Electrical analog information of the detected temperature is supplied to an analog-to-digital converter (A/D converter) 105, thus being digitized, and supplied to the power control means 104. Receiving the digital information corresponding to the temperature detected by the thermistor TH, the power control means 104 controls the power supply from the commercial power source 102, to the heat-generating resistor member 22*b* in such a manner that the temperature detected by the thermistor TH remains within a predetermined range with respect to a target temperature.

For the power supply control from the commercial power source 102 to the heat-generating resistor member 22*b* by the power control means 104 there is adopted a phase control in which a phase range of the power supply from the commercial power source 102 to the heat-generating resistor member 22*b* is varied for every half cycle of the AC power supply from the commercial power source 102 according to the temperature detected by the thermistor TH, or a wave number control in which the power from the commercial power source 102 to the heat-generating resistor member 22*b* is supplied or cut off for every half cycle according to the temperature detected by the thermistor TH. The heat-generating resistor member 22*b* of the ceramic heater 22 is preferably provided linearly symmetrically with respect to a center in the shorter direction (sheet conveying direction) of the ceramic substrate 22*a*. Such structure provides a better stress balance in the ceramic substrate under the heat generation by the heat-generating resistance member, thereby providing an advantage that the ceramic substrate is not easily cracked. In the present embodiment, the heat-generating resistor member 22*b* of the ceramic heater 22 is provided at the center of the ceramic substrate 22*a* in the shorter direction thereof. Also in case the heat-generating resistor member 22*b* is provided in plural units, they are preferably provided linearly symmetrically with respect to the center in the shorter direction.

The present embodiment is featured in the shape of the guide portion 42*a* in such a manner, as shown in FIG. 1, that an imaginary line A, which is parallel to the guiding direction of the guide portion 42*a* for guiding the heating unit 20 toward the pressure roller 30 and which passes a center of the guide portion 42*a* in a direction perpendicular to the guiding direction thereof, is positioned at an upstream side, in the sheet conveying direction, of an imaginary line B which passes the center of the pressure roller 30 and is parallel to the guiding direction of the guide portion 42*a*. A center of the width of the heater 22 substantially coincides with the imaginary line A. Thus, the frame 40 has the guide portion 42*a* for mounting the heating unit 20 on the frame 40, and, in the sheet conveying direction, the pressure roller supporting portion 42*b* of the frame 40 is positioned at a downstream side of the imaginary line A passing through the center of the guide portion 42*a*. In the present embodiment, the imaginary line A passes through the center of the heater 22 in the sheet conveying direction.

Thus, according to the guiding direction of the guide portion 42*a*, the heating unit 20 is positioned in the upstream side of the pressure roller in the sheet conveying direction. Since the pressure roller supporting portion 42*b* of the frame 40 is so structured as to be positioned in the downstream side, in the sheet conveying direction, of the imaginary line passing through the center of the guide portion 42*a*, there can be easily realized a positional relationship in which the heating unit 20 is positioned in the upstream side of the pressure roller 30 in the sheet conveying direction. In the present embodiment, the imaginary line A is positioned upstream, by 0.6 mm, of the imaginary line B. Such configuration realizes, within the fixing nip portion N (namely within the width of the fixing nip portion N, hereinafter taken as the same meaning), a temperature distribution a and a pressure distribution b as shown in FIG. 7.

At first the temperature distribution a will be explained. The temperature distribution a implies heat distribution, which a certain point of the conveyed sheet S receives within the fixing nip portion N, represented as a distribution in time. The heat given the heater 22 is transmitted to the sheet S with a certain displacement toward the downstream side, as the transmission takes place through the fixing film 23 which is rotating in sliding contact with the heater 22. The temperature distribution a shows a peak temperature at about the center of the heater 22 in the sheet conveying direction, then retains the peak temperature to the downstream end of the fixing nip portion, and then shows a gradual temperature decrease after exiting from the fixing nip portion N by heat dissipation to the air. In this case, the peak temperature on the sheet is about 130-140° C. (controlled fixing temperature being 180° C.).

Figure 7:
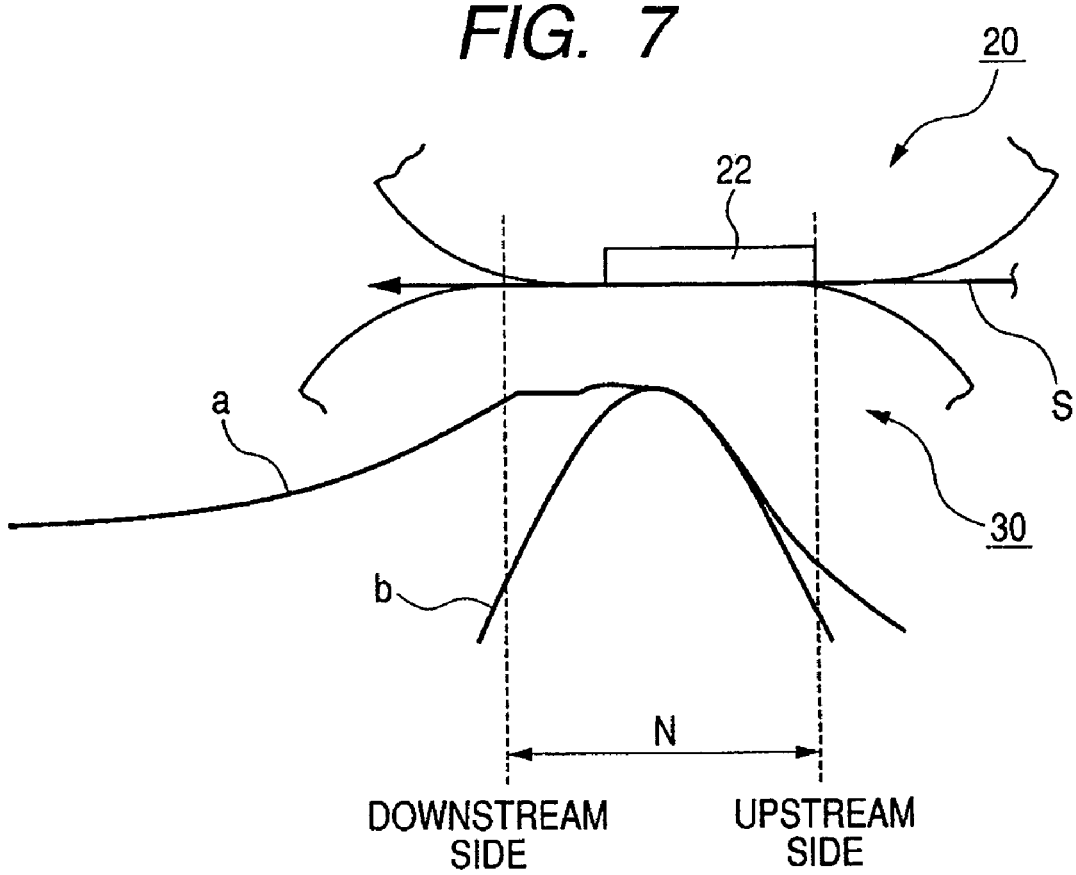
FIG. 7 is a view showing a temperature distribution and a pressure distribution in a fixing nip portion N.
Figure 8:
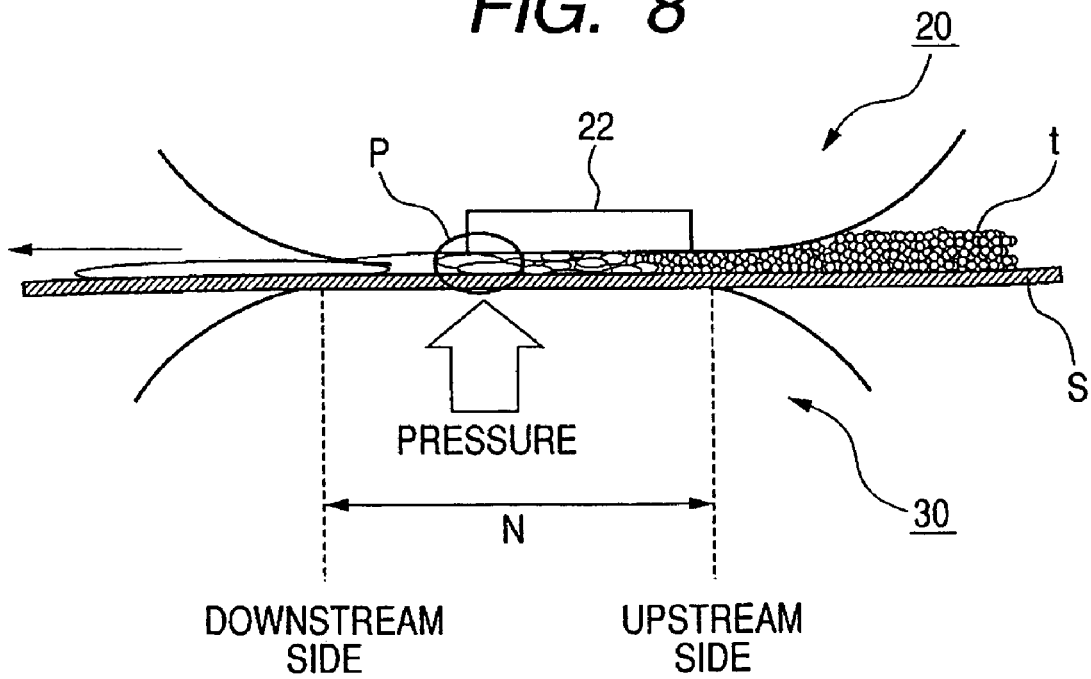
FIG. 8 is a view showing a toner fixing process.

Also the pressure distribution b shows a peak pressure in the downstream side within the fixing nip portion N as shown in FIG. 7, since the center of the pressure roller 30 in the pressurizing direction is positioned at the downstream side. Pressure and heat represented by such temperature distribution a and pressure distribution b are applied to the unfixed toner t on the sheet S, thereby effectively fixing the unfixed toner image t onto the sheet S. More specifically, as schematically shown in FIG. 8, the unfixed toner t is gradually fused by the monotonously increasing heat from the heater 22 (heating means), and is sufficiently fused in a downstream part P of the fixing nip portion N to assume a low viscosity state. The pressure is so designed as to reach its peak value in such downstream position P where the toner t is sufficiently fused to assume a low viscosity state, thereby enabling securer fixing of the unfixed toner t to the sheet S.

FIG. 8 illustrates the fixing process for the toner t in the fixing nip portion N in an easily understandable manner, by exaggerating a thickness of the sheet S and a particle size of the toner.

COMPARATIVE EXAMPLE 1

Figure 9:
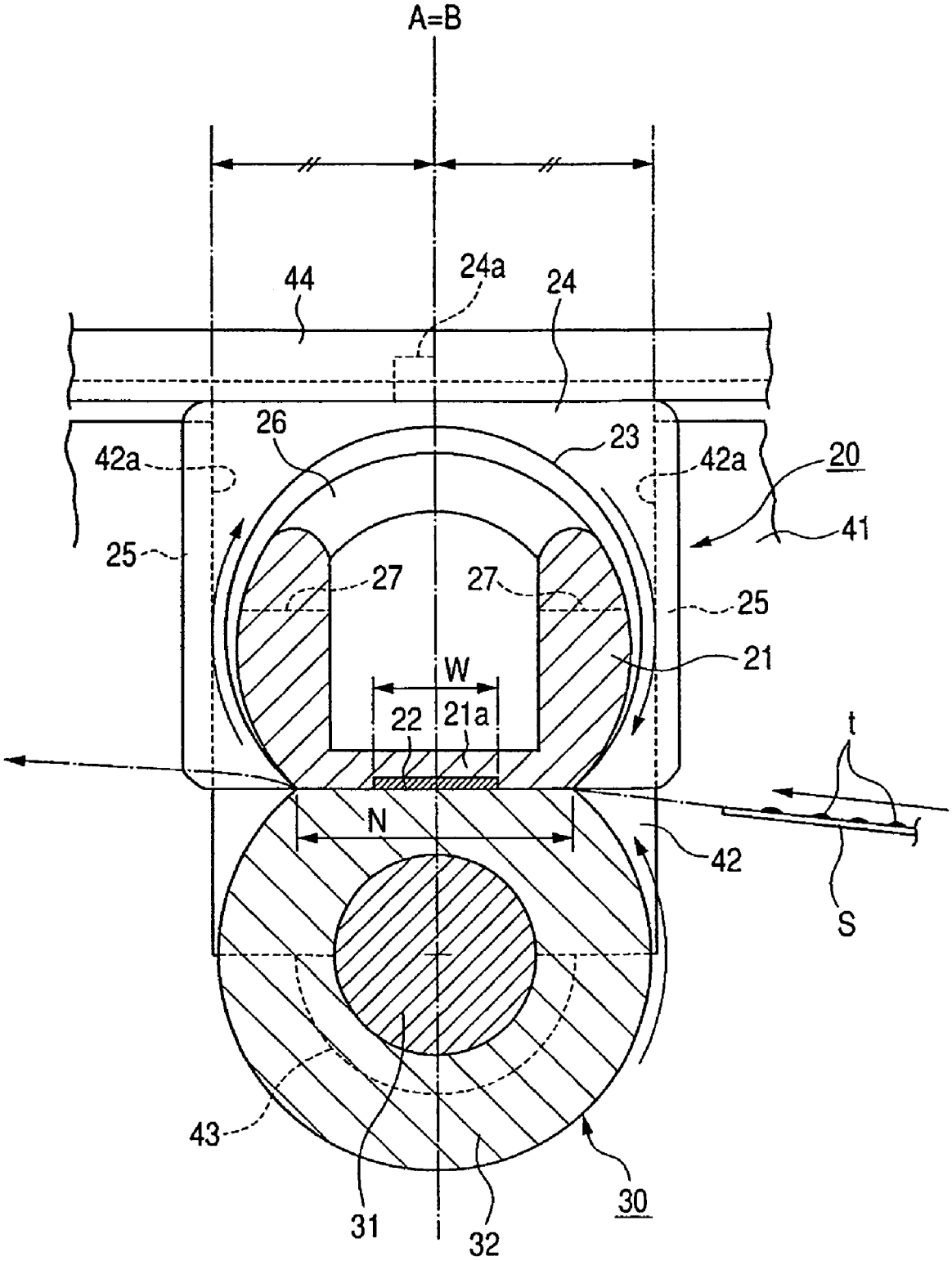
FIG. 9 is a view showing a positional relationship of a heating unit and a pressure roller in a prior fixing apparatus.

FIG. 9 shows a configuration of a prior fixing apparatus having a similar structure, but the guide portion 42*a* and the pressure roller supporting portion of the frame are so constructed in such a manner that the imaginary line, which passes through the center of the guide portion 42*a* in a direction perpendicular to the guiding direction thereof, and the imaginary line B, which passes the center of the pressure roller 30 and is parallel to the guiding direction of the guide portion 42*a*, are on a same straight line. In the following, a difference in the fixing efficiency will be explained between the fixing apparatus of such prior configuration and the fixing apparatus 15 of the configuration of the embodiment 1. Other structures than the aforementioned configuration of the fixing apparatus are assumed to be same as those in the embodiment 1.

Figure 10:
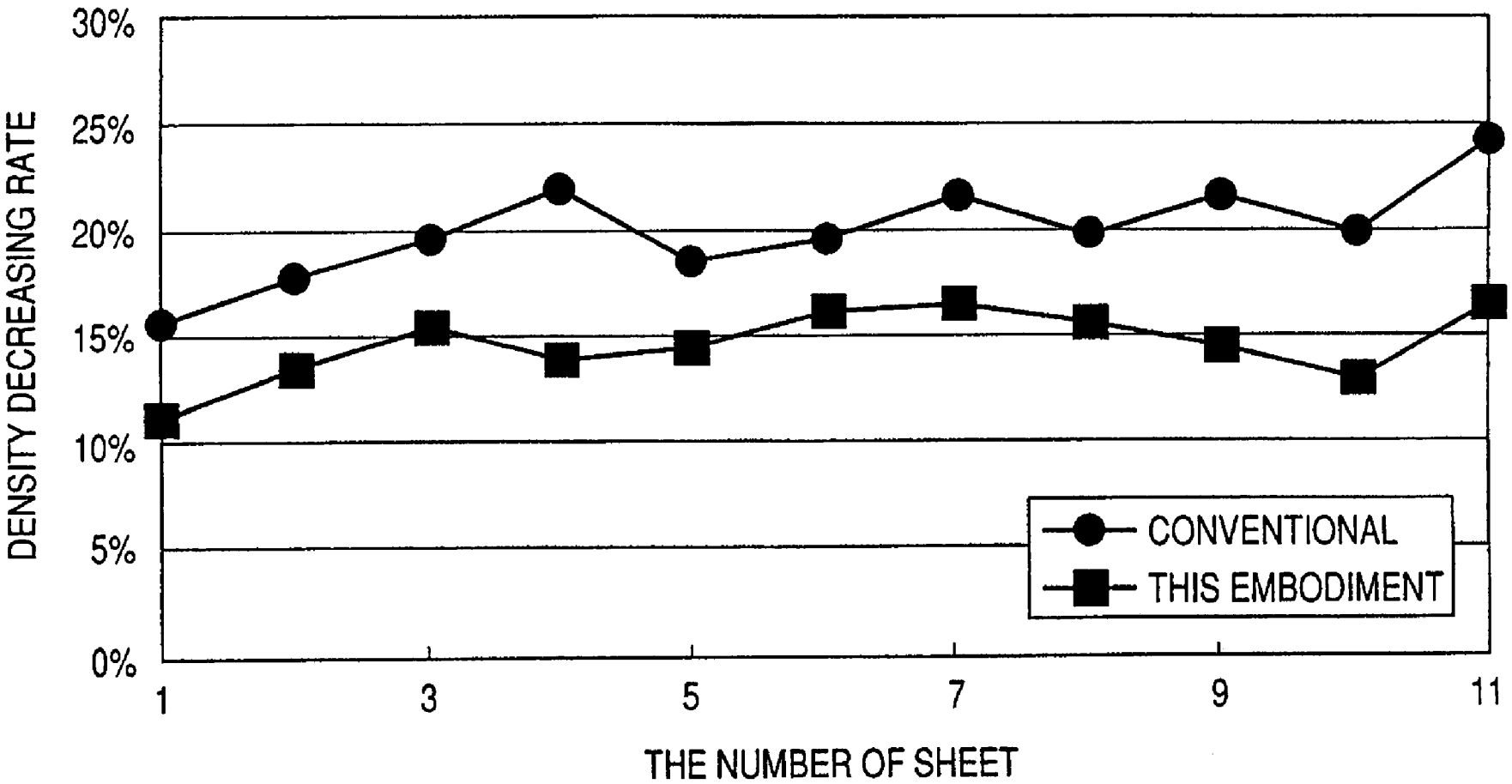
FIG. 10 is a chart showing a comparison of fixing property in a comparative example 1.

FIG. 10 shows the result of fixing property in case the fixing apparatus of the prior structure (FIG. 9) or the fixing apparatus 15 of the embodiment 1 is incorporated in the above-described image forming apparatus (FIG. 16). The measurement shows a comparison of a density decrease rate when 11 sheets are passed continuously at same controlled fixing temperature of 180° C. The density decrease rate means a rate of density decrease, when the fixed image is rubbed with a lens-cleaning paper "Dusper", manufactured by Ozu Paper Co., Ltd., under a load of 9.8 kPa (100 g/cm$^2$), before and after the rubbing. The density was measured with a reflective densitometer RD9, manufactured by McBeth Inc. Thus a lower density decrease rate means a better fixing property.

The results indicate that the embodiment 1 showed a lower density decrease rate lower, by about 5%, than in the prior configuration, thus being superior in the fixing property.

Figure 11:
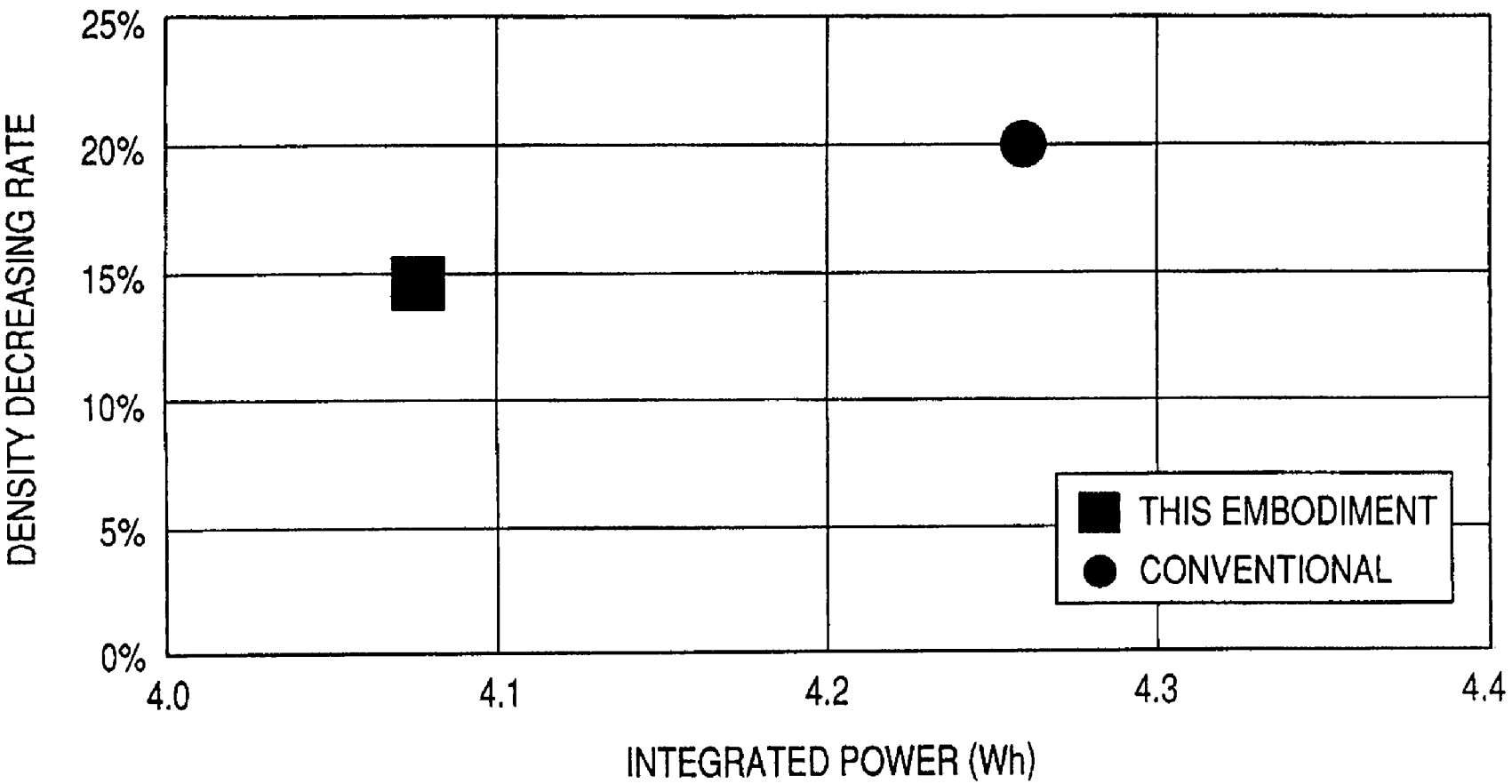
FIG. 11 is a chart showing a relationship between the fixing property and an integrated electric power (density decrease rate as a function of integrated electric power) in a comparative example 1.

Also FIG. 11 shows an average density decrease rate and an integrated electric power consumption when 11 sheets are passed continuously. These results show that the present embodiment shows not only a better fixing property but also a lower integrated electric power consumption. This is because the configuration of the embodiment shows a more efficient heat transmission to the sheet, with a lower heat amount dissipated to the air and the like; thereby suppressing the electric power supply in comparison with the prior configuration.

Thus, the present embodiment indicates that the toner t can be securely fixed to the sheet S with a lower electric power, by such a setting that the peak heat is positioned from the upstream side to the center within the fixing nip portion N as shown in FIG. 7 thereby gradually fusing the unfixed toner t, and that the peak pressure is positioned in the low-viscosity state of the toner. Therefore, the present embodiment can suppress the electric power consumption in comparison with the prior technology, by a simple-structure that the pressure roller supporting portion 42*b* of the frame 40 is positioned at the downstream side, in the sheet conveying direction, of the imaginary line A passing through the center of the guide portion 42*a*.

Figure 12A:
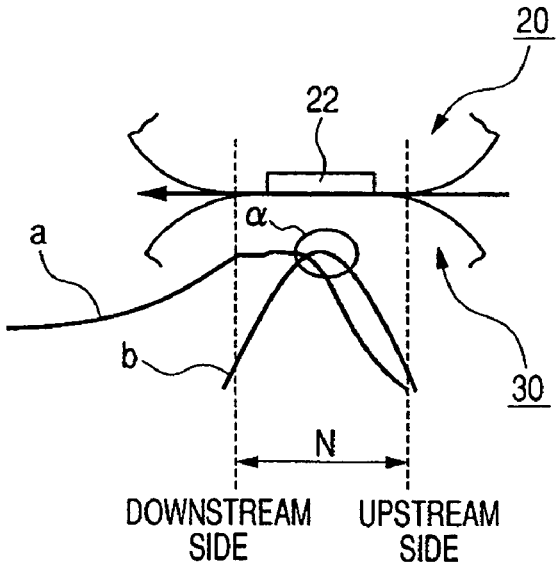
FIG. 12A is view showing a temperature distribution and a pressure distribution in a prior configuration, as a comparative example 1 in FIG. 12B.
Figure 12B:
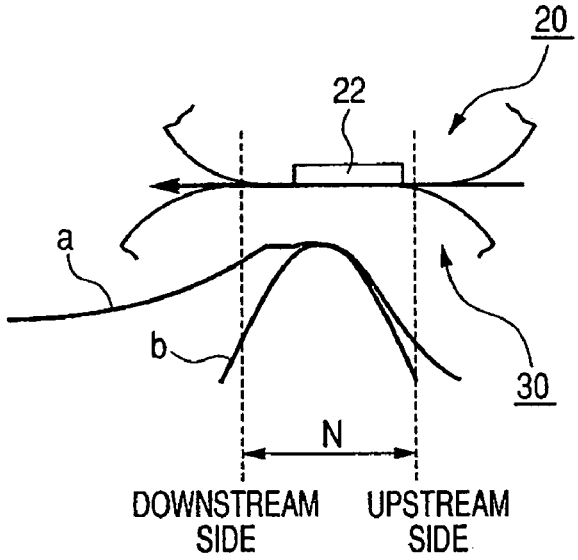
FIG. 12B is view showing a temperature distribution and a pressure distribution in the embodiment, as a comparative example 1 in FIG. 12A.
Figure 13:
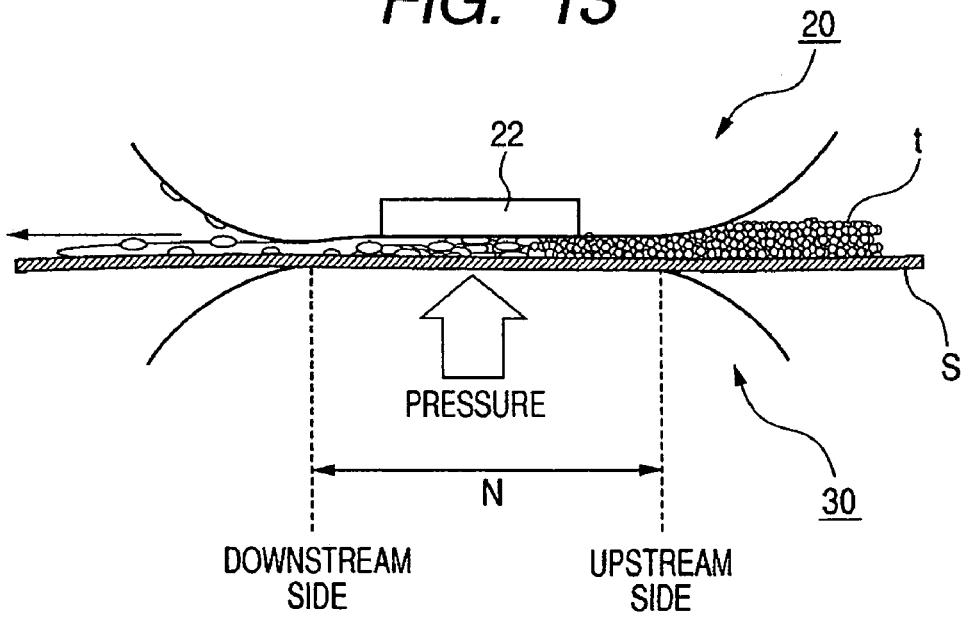
FIG. 13 is a view showing a toner fixing process in a prior fixing apparatus.

FIGS. 12A and 12B show a temperature distribution a and a pressure distribution b respectively in a prior configuration and in the present embodiment. In the prior configuration, as shown in FIG. 12A, the pressure distribution reaches a peak before the temperature distribution a reaches a peak. Consequently, the peak pressure is applied in a state where the toner t is not fully fused and has a high viscosity, so that the toner t is incompletely fixed to the sheet S.

Besides, as the toner t on the sheet is excessively heated in an area, with a relatively low, pressure, at the sheet exit of the fixing nip portion N and shows a lowered elasticity of the toner t, there results a "hot offset" phenomenon in which the toner t is offset to the film. Such "hot offset"phenomenon tends to occur particularly when the pressure is low at the separation.

Thus, the configuration of the present embodiment allows to efficiently transmit the heat from the heater 2 to the toner t and the sheet S, thereby improving the fixing property.

COMPARATIVE EXAMPLE 2

In this example, a comparative measurement was conducted, based on the comparative example 1, for determining the upstream position, providing the best fixing efficiency, of the heating unit (heating member) 20 with respect to the pressure roller 30.

Figure 14A:
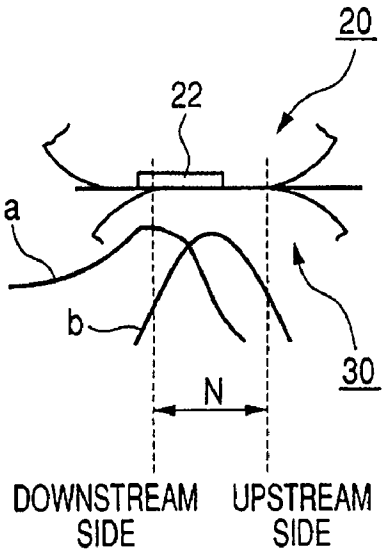
FIG. 14A is a view showing a positional relationship of a heating unit and a pressure roller in a comparative example 2 and a temperature distribution and a pressure distribution thereof, wherein a heating unit 20 is provided at a downstream position of 0.6 mm in comparison with that in the prior example in the sheet conveying direction.
Figure 14B:
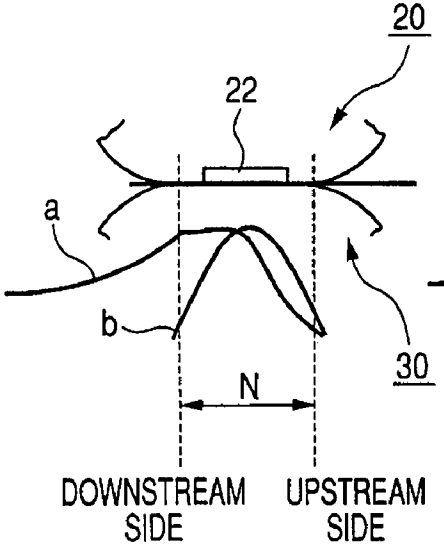
FIG. 14B is a view showing a positional relationship of a heating unit and a pressure roller in a comparative example 2 and a temperature distribution and a pressure distribution thereof, wherein the heating unit 20 is provided at a position in the prior example.
Figure 14C:
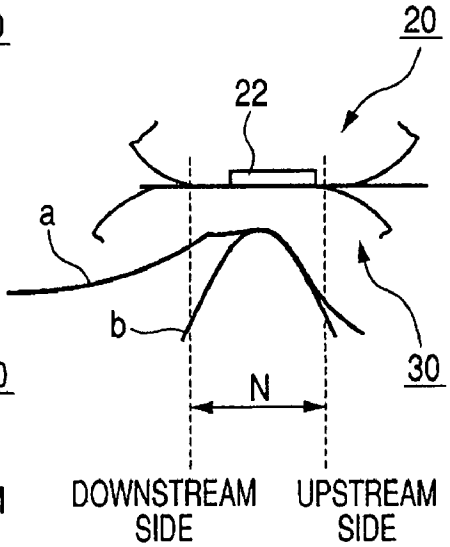
FIG. 14C is a view showing a positional relationship of a heating unit and a pressure roller in a comparative example 2 and a temperature distribution and a pressure distribution thereof, wherein a heating unit 20 is provided at an upstream position of 0.6 mm in comparison with that in the prior example in the sheet conveying direction.
Figure 14D:
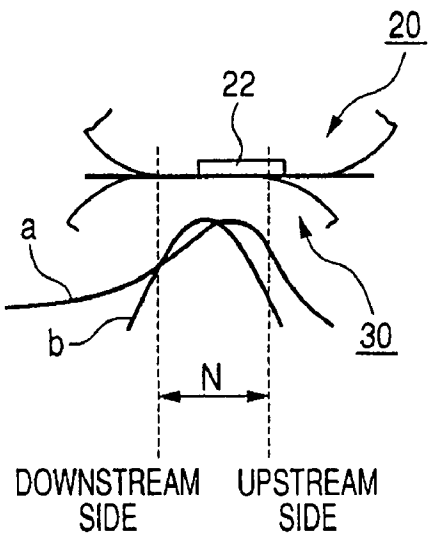
FIG. 14D is a view showing a positional relationship of a heating unit and a pressure roller in a comparative example 2 and a temperature distribution and a pressure distribution thereof, wherein a heating unit 20 is provided at an upstream position of 1.2 mm in comparison with that in the prior example in the sheet conveying direction.

In addition to the two comparative levels explained in the comparative example 1, FIGS. 14A to 14D illustrate the comparative example 2. FIG. 14A is a view showing a positional relationship of a heating unit and a pressure roller in the comparative example 2 and a temperature distribution and a pressure distribution thereof, wherein the heating unit 20 is provided at a downstream position of 0.6 mm in comparison with that in the prior example in the sheet conveying direction; FIG. 14B is a view showing a positional relationship of the heating unit and the pressure roller in the comparative example 2 and a temperature distribution and a pressure distribution thereof, wherein the heating unit 20 is provided at the position in the prior example; FIG. 14C is a view showing a positional relationship of the heating unit and the pressure roller in the comparative example 2 and a temperature distribution and a pressure distribution thereof, wherein the heating unit 20 is provided at an upstream position of 0.6 mm in comparison with that in the prior example in the sheet conveying direction; and FIG. 14D is a view showing a positional relationship of the heating unit and the pressure roller in the comparative example 2 and a temperature distribution and a pressure distribution thereof, wherein the heating unit 20 is provided at an upstream position of 1.2 mm in comparison with that in the prior example in the sheet conveying direction. Each of FIGS. 14A to 14D shows the temperature distribution a and the pressure distribution b. Also a comparison of fixing property and integrated electric power in case of continuous passing of 11 sheets is shown in FIG. 15, which shows a comparison of the density decrease rate as a function of the average integrated electric power.

Figure 15:
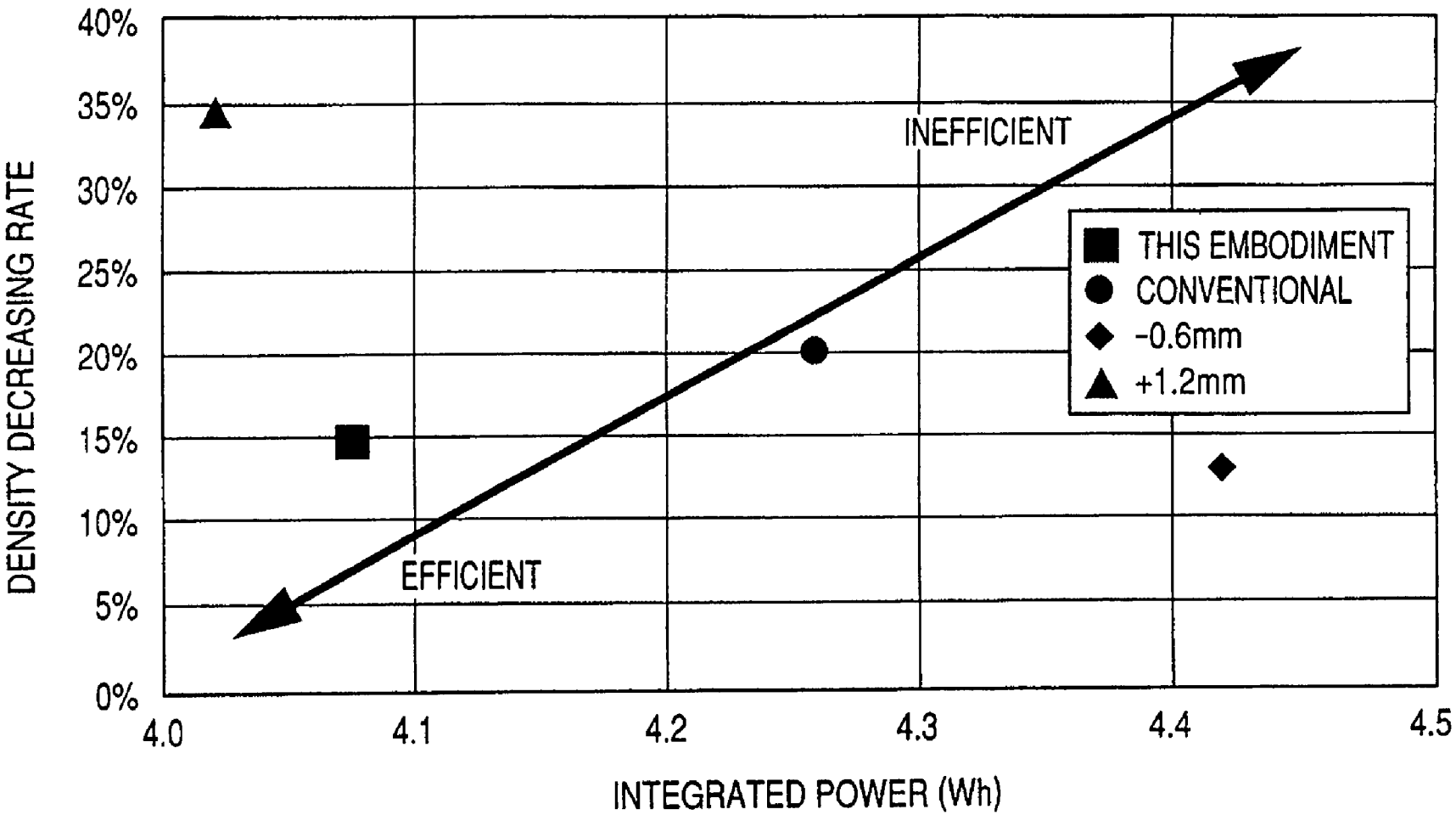
FIG. 15 is a chart showing a relationship between the fixing property and an integrated electric power (density decrease rate as a function of integrated electric power) in a comparative example 2.

Referring to FIG. 15, when the heating unit 20 was positioned at 0.6 mm in the downstream side (−0.6 mm), the fixing property was almost same as that in the embodiment, but the integrated electric power showed a significant increase. When the heating unit 20 is displaced by 0.6 mm to the downstream side, the downstream part of the heater 22 gets out of the nip portion N, thereby reducing the heating width. Also in this case, the heat from the heater 22 is transmitted, by the rotation of the fixing film 23, to the downstream side of the fixing nip portion N, and escapes by a larger amount into the air (to the exterior of the fixing device) through the internal film surface guide member 21 and the fixing film 23. The temperature detected by the unillustrated temperature detector. (thermistor) therefore becomes lower, so that an unnecessarily large electric power is supplied so as to maintain the control temperature of 180° C. Consequently the temperature in the fixing nip portion N becomes higher to provide a relatively satisfactory fixing property, but a larger heat dissipation requires a wasted electric power supply, resulting in an inefficient heat conduction. Also in this configuration, because of a higher temperature at the sheet separation than in the prior configuration, the "hot offset" phenomenon explained before became more serious.

Also in case the heating unit 20 is displaced by 1.2 mm to the upstream side (+1.2 mm), the upstream part of the heater 22 gets out of the nip portion N, thereby reducing the heating width. Also in this case, the heat from the heater 22 is transmitted, by the rotation of the fixing film 23, to the downstream side, but it is directed toward the fixing nip portion N and escapes little to the exterior. Also, as the heater does not form the fixing nip portion N in contact with the pressure roller 30, the heat is accumulated in the heating unit. Therefore the temperature detected by the unillustrated temperature detector (thermistor) becomes higher to suppress the electric power supply, thereby resulting in a lower temperature in the fixing nip portion N, which significantly deteriorates the fixing property in combination with the narrower nip width.

Therefore, in the fixing apparatus, an excellent "fixing efficiency" can be attained by transmitting the heat from the heater 22 to the sheet S with a minimum electric power, without a large heat dissipation to the exterior. In the chart showing the density decrease rate and the integrated electric power as in FIG. 15, the "fixing efficiency" is better for a lower density decrease rate and a lower integrated electric power, and, in the configuration of the image forming apparatus of the embodiment 1, the "fixing efficiency" is found to be best when the heating unit 20 is displaced to the upstream side by 0.5 to 0.7 mm (in FIG. 1, the line A is displaced to the upstream side from the line B by 0.5-0.7 mm). This figure is variable to a certain extent by the image forming speed of the image forming apparatus and the dimension of the pressure roller/heating unit, but the basic concept for optimizing the "fixing efficiency" is to regulate the positional relationship of the heating unit 20 and the pressure roller 30 so as to position the heating unit 20 at the upstream side of the fixing nip portion N, also to apply a sufficient pressure at the downstream side in the fixing nip portion N, and to position the peak pressure in the downstream side of the nip, matching the peak of the temperature distribution.

In the positional relationship of the heating unit 20 and the pressure roller 30, as explained in the foregoing, the fixing property is better in a configuration where the heating unit 20 is positioned at the upstream position of the pressure roller 30. Also from the standpoint of "fixing efficiency" in consideration of the electric power supply, it is most desirable to maximize the nip width between the heating unit 20 and the pressure roller 30 to be employed and to incorporate the heater 22 within the fixing nip portion N. Also, even if the substrate of the heater 22 somewhat gets out, of the nip portion N, it is desirable that the heat-generating member (not shown) is contained within the nip portion N.

The guide structure explained above allows a fixing apparatus to provide an excellent "fixing efficiency", with a simple and compact structure and with a lowered cost.

As explained in the foregoing, a fixing apparatus of an excellent "fixing efficiency" with a low electric power consumption and a low density decrease rate can be realized by setting the shape of the guide portion 42*a* in such a manner that the imaginary line A, which is parallel to the guiding direction of the guide portion 42*a* for guiding the heating unit 20 toward the pressure roller 30 and which passes the center of the guide portion 42*a* in a direction perpendicular to the guiding direction thereof, is positioned at an upstream side, in the sheet conveying direction, of the imaginary line B which passes the center of the pressure roller 30 and is parallel to the guiding direction of the guide portion 42*a*. Also as such setting can be realized only by the shape of the guide portion, the fixing apparatus can be assembled simply with a satisfactory precision.

As the pressure roller supporting portion 42*b* of the frame 40 is so constructed as to be positioned at the downstream side, in the sheet conveying direction, of the imaginary line A passing through the center of the guide portion 42*a*, the positional relationship of the heating unit 20 and the pressure roller 30 (particularly that of the heater 22 and the pressure roller 30) can be easily set in the above-described positional relationship.

Embodiment 2

Figure 17:
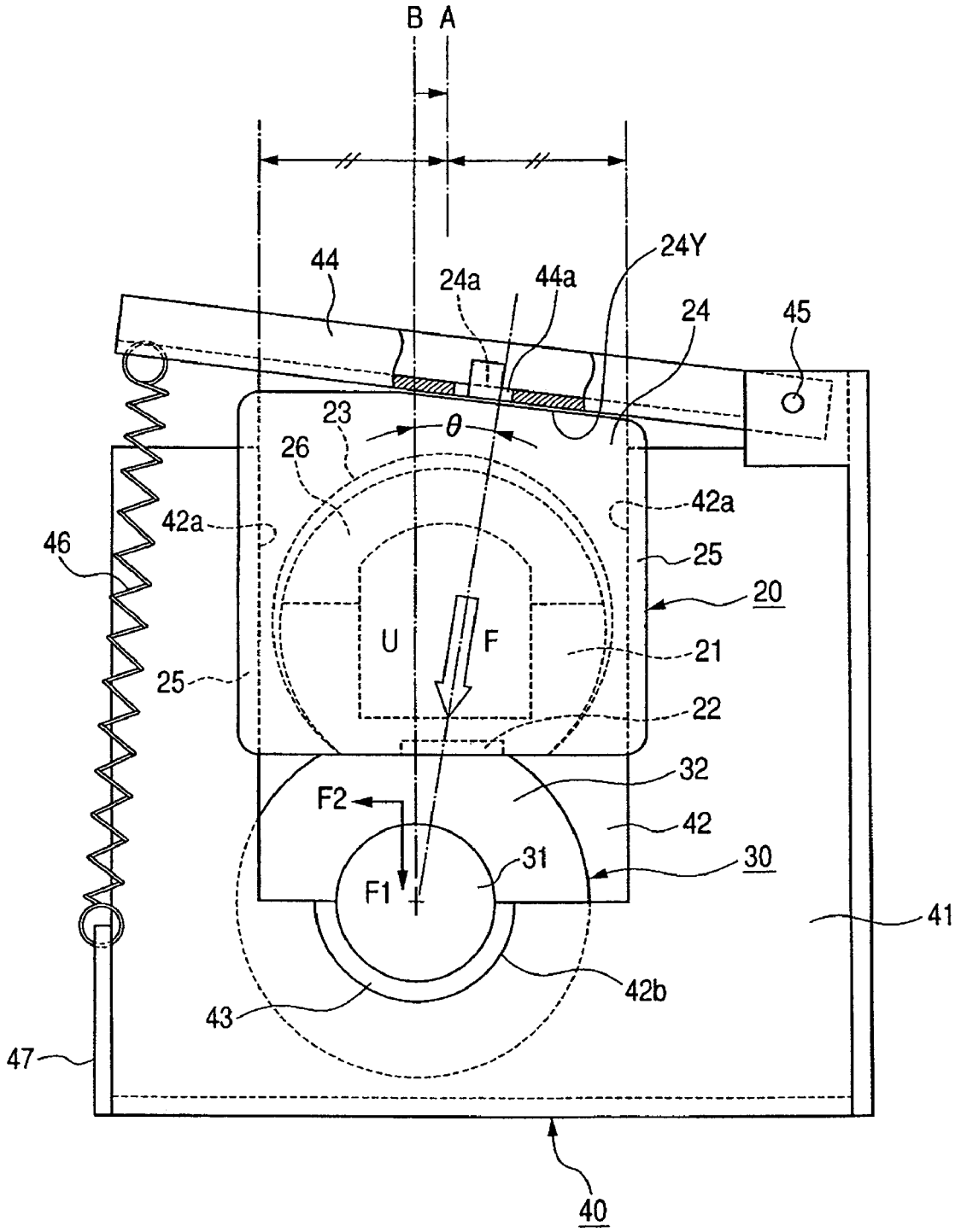
FIG. 17 is a partially cut-off magnified left-side lateral view of the fixing apparatus in an embodiment 2.

FIG. 17 is a schematic view of a fixing apparatus as an image heating apparatus in this embodiment, in which components and parts common with those in the fixing apparatus of the present embodiment are represented by same numbers and are not explained further.

It is different from the embodiment 1 in that, while a surface of the heating unit 20 for receiving a force F from the pressurizing metal plate 44 is substantially perpendicular in the embodiment 1 to the direction of the force F, such surface of the heating unit 20 for receiving the force F from the pressurizing metal plate 44 is not perpendicular to the direction of the force F.

In the fixing apparatus of the present embodiment, the pressurizing plate 44 is so directed that the pressing direction of the heating unit to the pressure roller 30 has an angle of $0° < \theta < 30°$, in the upstream side of the sheet conveying direction, with respect to a line U parallel to the guiding direction of the guide portion 42*a* for guiding the heating unit 20 toward the pressure roller 30. In order to realize an angle of the pressurizing plate 44 within the range $0° < \theta < 30°$, the flange 24 is provided, on an upper surface thereof, with an inclined surface 24Y as shown in FIG. 17.

The above-described configuration can also provide a fixing apparatus of an excellent "fixing efficiency" as in the embodiment 1, since the temperature distribution and the pressure distribution within the fixing nip portion N are basically same as those in the embodiment 1.

Also in the above-described configuration, the pressurizing direction F inclined by an angle θ, to the upstream side of the fixing-nip portion, from normal line U to the fixing nip portion generates a force F1 perpendicular to the fixing nip plane and also a force F2 parallel to the fixing nip plane. It improves the stability of the sheet S in conveying and alleviates unevenness in the pressure such as a local pressure loss within the fixing nip portion N, thereby enabling uniform fusing and pressurization of the toner, and realizing a stable fixing property and a stable image quality.

An inclination angle equal to or more than 30° causes the perpendicular pressure F1 to the sliding surface to be excessively lost in the force F2 in the sheet conveying direction whereby, though the conveying stability is improved, the contact with the image bearing surface of the sheet S is lowered or becomes unstable, and the toner image-bearing surface loses uniformity after the fixing operation. Therefore, the pressurizing direction F selected within the aforementioned range allows a uniform surface of the toner image-bearing surface to be obtained after the fixing operation and stable fixing and conveying performances at the same time.

Also in order to generate a force F2 parallel with the fixing nip plane, a gap of 0.18 mm is provided between the supporting frame fitting portion 25 of the flange member 41 and the guide portion 41*a* of the lateral plate 41 of the metal plate frame. In the present configuration, in order to minimize the pressure loss of the force F and to suppress a fluctuation in the position of the heating unit (upper unit) 20 in the course of sheet conveying thereby realizing a stable sheet conveying, the gap between the fitting portion 25 and the guide portion 41*a* is preferably within a range of 0.1- 0.25 mm.

The angle θ of the pressurizing direction F from the normal line U to the sliding plane is selected appropriately according for example to a frictional coefficient between the sheet and the sliding plane, but is effect within up to about 30°.

As explained in the foregoing, it is possible to obtain not only an excellent "fixing efficiency" but also a stable sheet conveying property and also a resulting high image quality in the fixing apparatus, by selecting the shape of the guide portion in such a manner that the imaginary line A, which is parallel to the guiding direction of the guide portion 42*a* for guiding the heating unit 20 toward the pressure roller 30 and which passes the center of the guide portion 42*a* in a direction perpendicular to the guiding direction thereof, is positioned at an upstream side, in the sheet conveying direction, of the imaginary line B which passes the center of the pressure roller 30 and is parallel to the guiding direction of the guide portion 42*a*, and that the pressurizing direction has an angle of $0° < \theta < 30°$, in the upstream side of the sheet conveying direction, with respect to the guiding direction of the guide portion. The stable sheet conveying avoids perturbation in the image to realize a stable image without unevenness in the fixation, thereby attaining a high image quality. Also as such setting can be realized only by the shape of the guide portion, the fixing apparatus can be assembled simply with a satisfactory precision.

In the heat unit 20, the heating member 22 is not limited to so-called ceramic heater but can also be, a PTC (positive temperature coefficient) heater or another heating member such as an electromagnetic induction heating member. Also the insulating ceramic substrate may be replaced by a metal plate having an insulating treated surface.

The image heating apparatus of the invention is applicable not only to an image heat fixing apparatus as in the foregoing embodiments but also to an image heating apparatus for heating a recording material, bearing an image thereon, for improving a surface property such as luster, or an image heating apparatus for temporarily fixing an unfixed image on a recording material.

This application claims priority from Japanese Patent Application No. 2004-367624 filed on Dec. 20, 2004, which is hereby incorporated by reference herein.

What is claimed is:

1. An image fixing apparatus for fixing a toner image formed on a recording material, comprising:

a heating unit including a heater, a flexible sleeve which rotates in contact with the heater, an internal film surface guide member for holding the heater and for guiding the flexible sleeve, and flange members mounted on both longitudinal ends of the internal film surface guide member;

an elastic roller for constituting a nip, in cooperation with the heater and the internal film surface guide member through the flexible sleeve, for heating the recording material under pinching and conveying;

a frame for supporting the heating unit and the elastic roller, wherein the frame includes roller supporting portions for supporting the elastic roller, and a guide portion for mounting the heating unit on the frame by guiding the flange members;

pressing plates for pressing the flange members; and pressurizing springs for biasing the pressing plates toward the elastic roller, wherein the roller supporting portions of the frame are positioned, in a conveying direction of the recording material, in a downstream position of an imaginary line passing through a center of the guide portion and the roller supporting portions of the frame are positioned, in the conveying direction of the recording material, in a downstream position of a center of the heater, wherein the nip includes a first region formed by the heater and the elastic roller and a second region, provided downstream of the first region in the conveying direction of the recording material, formed by the internal film surface guide member and the elastic roller, wherein the nip begins at the first region, and the nip is planar from an inlet of the nip to an outlet of the nip, and wherein each of the flange members has an inclined surface onto which each respective one of the pressing plates contacts in a state where an angle between a pressing direction by each of the pressing plates and the imaginary line is more than 0 degrees and less than 30 degrees.

2. An image fixing apparatus to claim 1, wherein the guide portion is a groove provided in the frame, and the roller supporting portion is provided on a bottom of the groove.

3. An image fixing apparatus according to claim 1, wherein the imaginary line passes through the center of the heater in the conveying direction.

4. An image fixing apparatus according to claim 3, wherein the heater includes a ceramic substrate and a heat-generating resistance member provided on the ceramic substrate, and the heat-generating resistance member is provided linearly symmetrically with respect to a center line of the ceramic substrate in the conveying direction.

* * * * *